United States Patent [19]

Tamai et al.

[11] 4,062,789

[45] Dec. 13, 1977

[54] LIQUID DEVELOPER FOR ELECTROPHOTOGRAPHY

[75] Inventors: Tasuo Tamai; Sadao Osawa; Hajime Miyatuka; Masaya Yamamoto, all of Minami-ashigara, Japan

[73] Assignee: Fuji Photo Film Co., Ltd., Minami-ashigara, Japan

[21] Appl. No.: 465,945

[22] Filed: May 1, 1974

Related U.S. Application Data

[63] Continuation-in-part of Ser. No. 188,592, Oct. 12, 1971, abandoned.

[30] Foreign Application Priority Data

Oct. 12, 1970 Japan ..... 45-88778

[51] Int. Cl.[2] ..... G03G 9/12

[52] U.S. Cl. ..... 252/62.1 L; 96/1 LY; 427/15; 427/17

[58] Field of Search ..... 96/1 LY; 252/62.1; 427/15, 17

[56] References Cited

U.S. PATENT DOCUMENTS 3,772,199 11/1973 Tamai et al. ..... 252/62.1

FOREIGN PATENT DOCUMENTS 2,150,802 4/1972 Germany.

1,093,081 11/1967 United Kingdom ..... 252/62.1 L

*Primary Examiner*—Mayer Weinblatt

*Assistant Examiner*—John D. Smith

*Attorney, Agent, or Firm*—Sughrue, Rothwell, Mion, Zinn and Macpeak

[57] ABSTRACT

A liquid developer for electrophotography is disclosed which comprises toner particles, a regulating agent composed of a copolymer of a half-alkylamide of maleic acid and α-diisobutylene and an electric insulating carrier liquid and, if desired, an organic acid.

17 Claims, No Drawings

LIQUID DEVELOPER FOR ELECTROPHOTOGRAPHY

CROSS REFERENCE TO RELATED APPLICATION

This application is a continuation-in-part of U.S. Ser. No. 188,592 Tamai et al filed Oct. 12, 1971 now abandoned and entitled "Liquid Developer for Electrophotography".

BACKGROUND OF THE INVENTION

1. Field of the Invention

The present invention relates to electrophotography, and in more detail to an improved liquid developer for converting electrostatic latent images to visible images in an electrophotographic process or in an electrostatic recording process. This improved developer is especially preferred for developing electrostatic latent images on an insulating surface by the use of toner particles which are positively charged.

2. Description of the Prior Art

In an electrophotographic process, a surface of the recording element used comprising a sensitive layer which comprises photoconductive zinc oxide on a support having a comparatively high conductivity is uniformly negatively charged in the dark. An optical image of an original is then projected onto the charged surface of the sensitive layer, whereby the uniformly charged surface is partially discharged, corresponding to the intensity of the light applied, to form an electrostatic latent image. By applying electroscopic toner particles to this electrostatic latent image, a visible image is produced. In the electrofax process, this visible image is fixed directly to the photoconductive surface.

It is necessary, in common reproduction systems, to obtain a positive copy from a positive original.

Accordingly, when the surface of the sensitive layer is negatively charged, the electroscopic toner particles are positively charged, and it is preferred that the positive charge be strong and stable.

Many kinds of liquid developers containing toner particles having a positive charge have been marketed. However, these marketed developers are intended to be used for copying line or dotted images, and thus are not suitable for reproducing continuous gradation images. When continuous gradation images are reproduced using the hitherto marketed liquid developers or liquid developers having formulations known in the art, faults such as the following are observed:

1. Sufficient image density is not obtained;
2. Flowing of toner (so-called streaking) is caused on the resulting image, and
3. Fog is formed due to deposition of the toner on non-image parts.

In order to reproduce a continuous gradation image, it is generally desirable that the optical density of the image be above 2.0 and the optical density of fog be below 0.15 and that "streaking" of the image not occur. With a liquid developer, it is required that the dispersion of the toner particles be stable for a long period of time and that the positive charge on the toner neither decrease nor change into the opposite polarity.

British patent specification No. 1,093,081 discloses copolymers of a half-alkylamide and diisobutylene. No usage in an electrophotographic environment is suggested.

3. Objects of the Invention

An object of the present invention is to improve the above-mentioned faults of prior art liquid developers and to provide an excellent liquid developer by which a good continuous gradation image is obtained.

Other objects will be apparent to those skilled in the art as the description of this invention proceeds.

BRIEF DESCRIPTION OF THE INVENTION

The developer of the present invention is produced by mixing toner particles, a regulating agent composed of a copolymer of a half-alkylamide of maleic acid and α-diisobutylene, and, if desired, an organic acid, and an electric insulating carrier liquid.

The main feature of the present invention resides in a liquid developer for electrophotography containing a new and valuable charge controlling agent. Other components of the liquid developer known in the art, such as toner particles and a carrier liquid, may be used.

DETAILED DESCRIPTION OF THE INVENTION

In suitable compositions of this developer, there are used a pigment which is insoluble in the carrier liquid, such as carbon black, phthalocyanine blue (CI 74160), quinacridone magenta (CI Pigment Red 122) and benzidine yellow (CI 21090), etc., as toner particles, a copolymer of a half-alkylamide of maleic acid and α-diisobutylene alone or in combination with an organic acid such as a fatty acid as the charge controlling agent, and a hydrocarbon solvent(s) as the carrier liquid. The charge controlling agent acts to strongly positively charge the electrostatic atmosphere of the toner particles in the carrier liquid.

A preferred embodiment for producing the liquid developer of the present invention comprises producing a mixture of toner particles, a copolymer of a half-alkylamide of maleic acid and α-diisobutylene and, if desired, an organic acid, and a resin which is soluble in the carrier liquid, namely a concentrated pigment paste, and then diluting with a carrier liquid. Of course, a small amount of the carrier liquid may have been previously added to the concentrated pigment paste. Thus, it becomes possible to produce a developer containing toner particles of a desired concentration at use.

Further, it is preferred the toner have a particle size of less than 5 microns, especially less than 2 microns, in order to obtain a continuous gradation image.

The carrier liquid used in the present invention is not limited, so long as it does not degrade other constituents in the developer, and may be freely selected from those in the art, subject to the specific resistance and dielectric constant caveat below. Illustrative carrier liquids used in the developer include hydrocarbon solvents, for example, cyclohexane, decalin, kerosene, isoparaffinic hydrocarbon solvents, light oil, gasoline; chlorofluorinated hydrocarbon solvents, for example, $CCl_3F$, $CCl_2F$-$CCl_2F$, $CCl_2F$-$CClF_2$, etc. and silicone oil, which may be used singly or as a mixture thereof. The carrier liquid should have a specific resistance of more than $10^{11}\Omega$ cm and a dielectric constant of 3 or less in the absence of toner, resin and charge controlling agent. It is suitable in practice that the carrier liquid(s) be odorless, have moderate volatility and have a small solubility for the binder resin of a light-sensitive layer. Accordingly, isoparaffin-type solvents are most preferred. Kerosene is also preferred because of its very low price, despite its objectionable odor.

An electroscopic mixture is formed by mixing toner particles with a comparatively small amount of the copolymer of a half-alkylamide of maleic acid and α-diisobutylene.

Excellent characteristics result when an alkyl group in the alkylamide of the copolymer has 6–24 carbon atoms.

Commercially available diisobutylene generally comprises an isomeric mixture of α-diisobutylene, β-diisobutylene and other isomers. Such commercially available mixtures can be used in the present invention for copolymer formation since the β-diisobutylene and the other isomers, where the double bond is not at a terminal position as with the α-diisobutylene, have a very low reactivity and are essentially non-polymerizable. Therefore the copolymer which can be used in the present invention is a half-alkylamide of maleic acid and α-diisobutylene. The results of the present invention are not affected even though the copolymer might contain the β-form and other isomers.

The molar ratio of monomer in the copolymer may be varied in a wide range, but copolymers having a ratio of the half-alkylamide of maleic acid and α-diisobutylene of 1:1 to 1:5 are preferably used. The copolymers of these molar ratios show good solubility in the carrier liquid and a superior charge controlling effect. The copolymers of a relatively low polymerization degree are effective and those having a number of monomer units contained in the copolymer in the range of 4 to 50 show a good charge controlling propertiy.

If an alkylamide having an alkyl group of less than 12 carbon atoms is used as the charge controlling agent and kerosene or an isoparaffinic solvent is used as the carrier liquid, some degradation of preservation stability is observed because the charge controlling agent has low solubility in the carrier liquid. However, this degradation can be prevented by adding a small amount of an organic acid, since the charge controlling agent becomes soluble.

As the organic acid, acids containing an aromatic ring such as benzoic acid and succinic acid, chlorinated fatty acids such as monochloacetic acid, saturated fatty acids such as acetic acid, propinic acid, butyric acid, valeric acid, caproic acid, capric acid, lauric acid, myristic acid, palmitic acid, stearic acid, behenic acid and cerotic acid, and unsaturated fatty acids such as oleic acid, sorbic acid, linoleic acid and linolenic acid may be used. Among these acids, though many acids with the exception of the fatty acids have a low solubility to the carrier liquid, there is still a sufficient effect and strengthening of the positive charge of the toner particles if there is some solubility.

The copolymer of the half-alkylamide of maleic acid and α-diisobutylene having an alkyl group of 12 or more carbon atoms is soluble in kerosene or isoparaffin type solvent, but its preservation stability is improved when it is used together with an organic acid.

The resins soluble in the carrier liquid used on occasion in the present invention are employed as dispersion agent for the toner particles. Various kinds of well known alkyd resins, rosin modified phenol-formaldehyde resins, polystyrene, acrylic resins and polyisobutylene resins are preferably used. Various kinds of vegetable oils may also be used.

Further, the charge controlling agent of the present invention may also be employed in combination with a graft carbon type developing agent such as is described in Belgian Pat. No. 706,742 and U.S. Pat. Nos. 3,503,881 and 3,623,986. This type of developing agent comprises a reaction product produced by a graft-polymerization to a pigment such as carbon black of an alkyl ester of acrylic or methacrylic acid, and on occasion, further, of a small amount of a polar monomer such as acrylic acid, acrylic amide, etc.

The developing agent of this type is added to the carrier liquid together with the copolymer of the present invention to form a liquid developer having the above-mentioned superior properties. In this case it is not necessary to add a resin soluble in the carrier liquid to the carrier liquid.

The amount of each component in the present invention is illustrated as follows.

The toner particles are preferably used in the range of 0.5 to 50 parts by weight based on 1000 parts by weight of the carrier liquid. If the amount is less than 0.5 parts by weight, image density is not sufficient, while if it is above 50 parts by weight, fogging may be caused on non-image parts.

The copolymer of a half-alkylamide of maleic acid and α-diisobutylene as the charge controlling agent exhibits an excellent effect when used in a very small amount in the carrier liquid. A preferred effect is brought about when the charge controlling agent is used in an amount of 0.0003 to 0.5 parts by weight based on 1000 parts by weight of the carrier liquid. When the amount is below the above-mentioned range, "streaking" of the toner image is easily caused. When the amount is over the above-mentioned range, the electrical resistivity of the developer lowers and thus the optical density of the resulting image becomes low. The most preferred range is 0.005 to 0.2 parts by weight per 1000 parts by weight of the carrier liquid.

The organic acid is used as occasion demands. Though the amount of addition depends upon the kind of acid, effective results are obtained in general when adding an amount equal to or more than the amount of the copolymer. The organic acid may be added in an amount of up to 20 parts by weight based on 1000 parts by weight of the carrier liquid.

In the present invention, although it is not evident why the toner in the liquid developer has a stable strong positive charge for a long period of time, it is theorized that the charge controlling agent existing around the toner particle, that is, the copolymer of a half-alkylamide of maleic acid and α-diisobutylene, has an influence upon the electrostatic atmosphere of the toner particles so as to strongly charge them in the positive state, while the coexisting organic acid prevents dissociation of a maleic acid residue of the copolymer to further strengthen a reciprocal action between said copolymer and the toner particles.

The resins soluble in the carrier liquid are used as occasion demands. They can be used as a dispersing agent for the toner particles by addition in an amount in the range of 0.5 – 100 parts be weight based on 1000 parts by weight of the carrier liquid.

The upper limitation on the total amount of additives of the above-mentioned liquid developer is controlled by the electrical resistivity of the liquid developer. Namely, since a continuous gradation image having good quality is difficult to obtain when the electrical resistivity of the liquid developer in the state of removing the toner particles is less than $5 \times 10^{10}\Omega$ cm, it is necessary to control the amount of each additive within the limit thereof. In the case of removing the toner in a liquid developer, it is preferred to use an electrophoretic process.

The liquid developer of the present invention can be used in a conventional method to develop a latent image. According to the present invention an electrophotographic image can be formed using a method which comprises forming an electrostatic latent image and developing the electeostatic latent image with the liquid developer of the present invention.

After development, a photoconductive sheet is subjected to squeezing the developer with rollers. This process is conventionally used in a copying machine. The liquid developer containing the copolymer of the present invention is also effective in improving the resistance against squeezing.

The following examples, while in no way intended to be limiting, will further explain the invention.

EXAMPLE 1

Carbon black: 10 parts by weight
Copolymer of half-docosanylamide of maleic acid and α-diisobutylene: 0.1 parts by weight
Safflower oil modified alkyd resin (oil length 65%): 40 parts by weight
Kerosene: 50 parts by weight A concentrated pigment paste was prepared by kneading the above-mentioned ingredients in a ball mill for 40 hours. 10 parts by weight of the resulting concentrated paste were diluted with 1000 parts by weight of Isopar H (trade name for an isoparaffinic hydrocarbon solvent produced by Esso Standard Oil Co.) to produce a liquid developer for electrophotography.

A surface of a photoconductive zinc oxide sensitive layer was uniformly charged by a corona electrode of −7KV in the dark, and then an electrostatic latent image was formed on this surface by using a positive original having continuous gradation. The surface of the sensitive layer having this electrostatic latent image was wetted once with Isopar-H and developed in the above-mentioned liquid developer for 30 seconds using a developing electrode. After development, the excess liquid developer on the surface of the sensitive layer was removed by washing with fresh Isopar-E (an isoparaffinic solvent produced by Esso Standard Oil Co.). The sensitive layer was then dried. The resulting image had a good continuous gradation image which had a 2.21 maximum optical density and a minimum of 0.07 (fog). The tone of the image was warm.

EXAMPLE 2

A liquid developer for electrophotography was prepared by the same procedure as in Example 1, but further adding 5 parts by weight of oleic acid to the composition of the concentrated of pigment paste of Example 1. After wetting the surface of the sensitive layer with kerosene, it was developed by the same procedure as in Example 1. The resulting image had a 2.24 maximum optical density and a minimum of 0.06 (fog). The tone of the image was slightly warm as in Example 1.

EXAMPLE 3

A liquid developer was prepared by using a copolymer of the half-octadecylamide of maleic acid and α-diisobutylene instead of the copolymer of a half-docosanylamide of maleic acid and α-diisobutylene as was used in Example 1. When developed by the same procedure as in Example 1, nearly the same results were obtained.

EXAMPLE 4

A liquid developer was prepared using a copolymer of the half-octadecylamide of maleic acid and α-diisobutylene instead of the copolymer of the half-docosanylamide of maleic acid and α-diisobutylene as was used in Example 2. When developed by the same procedure as described above, nearly the same result was obtained.

EXAMPLE 5

A pigment paste consisting of the following composition was prepared.

Carbon black: 10 parts by weight
Copolymer of half-dodecylamide maleic acid and α-diisobutylene: 0.25 parts by weight
Soybean oil modified isophthalic acid alkyd resin (oil length 85%): 45 parts by weight
Isopar-H: 60 parts by weight A liquid developer was prepared by diluting 10 parts by weight of the resulting concentrated paste with 1000 parts by weight of decalin. By using this developer a good black image of slightly warn tone was obtained. "Streaking" of the image was caused in less degree than in Example 1.

EXAMPLE 6

2 parts by weight of linoleic acid were added to the pigment paste of Example 5 and the resulting paste was diluted with Isopar-H. A liquid developer was prepared by the same procedure as in Example 5. Using this developer, almost the same image as in Example 5 was obtained.

EXAMPLE 7

A liquid developer was prepared from a pigment paste consisting of the following composition. By using this developer, a pure black image was obtained.

Carbon black: 8.5 parts by weight
Alkali blue (Color Index: 42770A): 1.0 part by weight
Copolymer of half-docosanylamide of maleic acid and α-diisobutylene: 0.2 parts by weight
Soybean oil modified isophthalic acid alkyd resin (oil length 85%): 60 parts by weight
Isopar-E: 75 parts by weight

EXAMPLE 8

A liquid developer was prepared by the same procedure as described in Example 7 but using a half-decylamide compound instead of the half-docosanylamide compound in the pigment paste of Example 7, and further adding 1 part by weight of behenic acid. Using this developer, an excellent pure black image was obtained.

EXAMPLE 9

Phthalocyanine blue (CI 74160): 10 parts by weight
Copolymer of half-docosanylamide of maleic acid and α-diisobutylene: 0.2 parts by weight
Safflower oil modified alkyd resin (oil length 65%): 50 parts by weight
Kerosene: 50 parts by weight A developer was prepared by diluting a pigment paste consisting of the above-mentioned composition with Isopar-H. Using this liquid developer an excellent blue image was obtained.

EXAMPLE 10

A developer was prepared by the same procedure as described in Example 9 but using Isopar-H instead of kerosene in the pigment paste of Example 9, and further adding 0.5 parts by weight of stearic acid. Using this liquid developer an excellent blue image was obtained.

EXAMPLE 11

A liquid developer was prepared by diluting a yellow pigment paste containing benzidine yellow (CI 21090) instead of phthalocyanine blue in Example 9 with Isopar-H. Using this liquid developer an excellent yellow image was obtained.

EXAMPLE 12

A liquid developer was prepared by diluting a pigment paste containing a copolymer of the half-octylamide of maleic acid and α-diisobutylene instead of the half-docosanylamide of said copolymer as was used in Example 2 with kerosene. Using this developer, an excellent black image was obtained.

EXAMPLE 13

A liquid developer having the following composition was prepared.

The reaction product obtained by the graft polymerization of 5 parts by weight of carbon black, 7 parts by weight of lauryl methacrylate and 0.2 parts by weight of acrylic acid: 2 parts by weight
Copolymer of half-docosanylamide of maleic acid and α-diisobutylene: 0.05 parts by wt.
Isopar-H: 1000 parts by wt.

By the same procedure as was described in Example 11 except for using the above developer, a black image having a 2.25 maximum density and a minimum of 0.08 (fog) was obtained. No "streaking" was observed. After washing with Isopar-E, the sensitive layer was squeezed with metal rollers. The image was completely maintained.

For comparison, the same procedure was conducted but the copolymer of the present invention was omitted from the developer. The image obtained had a 1.85 maximum density and "streaking" was observed. The image was partly destroyed by squeezing with metal rollers.

While the invention has been described in detail and in terms of specific embodiments thereof, it will be apparent to one skilled in the art that various changes and modifications can be made therein without departing from the spirit and scope thereof.

What is claimed is:

1. A liquid developer for use in electrophotographic processes consisting essentially of:

1. a carrier liquid having a specific resistance of more than about $10^{11}\Omega$ cm selected from the group consisting of cyclohexane, decalin, kerosene, isoparaffinic hydrocarbon solvents, light oil, gasoline, chlorofluorinated hydrocarbon solvents and silicon oil,
2. from about 0.0003 to about 0.5 parts by weight per 1000 parts by weight of said carrier liquid of a copolymer of a half alkylamide of maleic acid and diisobutylene, the molar ratio of said half alkylamide of maleic acid to said diisobutylene in said copolymer being in the range of from about 1:1 to about 1:5 and said copolymer having from about 4 to about 50 monomer units in the copolymer chain, and
3. from about 0.05 to about 50 parts by f weight per 1000 parts by weight of said carrier liquid of positively charged toner particles having an average particle size of less than about 5 microns.

2. The liquid developer as claimed in claim 1 wherein said developer further contains up to about 20 parts by weight of an organic acid per 1000 parts by weight of said carrier liquid.

3. The liquid developer as claimed in claim 2, wherein said organic aid is an aromatic acid, a chlorinated fatty acid, a saturated fatty acid, or an unsaturated fatty acid.

4. The liquid developer as claimed in claim 3, wherein said organic acid is benzoic acid, succinic acid, monochloroacetic acid, acetic acid, propionic acid, butyric acid, valeric acid, caproic acid, capric acid, lauric acid,-myristic acid, palmitic acid, stearic acid, behenic acid, cerotic acid, oleic acid, sorbic acid, linoleic acid, or linolenic acid.

5. The liquid developer as claimed in claim 1, wherein said developer additionally contains a resin soluble in said carrier liquid, said resin being present in an amount of from about 0.5 to 100 parts by weight per 1000 parts by weight of said carrier liquid.

6. The liquid developer as claimed in claim 5 wherein said resin soluble in said carrier liquid is an alkyd resin, a rosin-modified phenolformaldehyde resin, polystyrene, an acrylic resin, or a polyisobutylene resin.

7. The liquid developer as claimed in claim 1, wherein said alkyl group of said half alkylamide of maleic acid contains from about 6 to about 24 carbon atoms.

8. The liquid developer as claimed in claim 7 wherein said alkyl group of said half alkylamide of maleic acid contains less than about 12 carbon atoms and wherein said developer further contains up to about 20 parts by weight of an organic acid per 1000 parts by weight of said carrier liquid.

9. The liquid developer as claimed in claim 1 wherein said toner particles have an average particle size of less than about 2 microns.

10. The liquid developer as claimed in claim 1 wherein said toner particles are carbon black, phthalocyanine blue, quinacridone magenta, or benzidine yellow.

11. The liquid developer as claimed in claim 1, wherein said copolymer of said half alkylamide of maleic acid and diisobutylene is present at a level from about 0.005 to about 0.2 parts by weight per 1000 parts by weight of said carrier liquid.

12. The liquid develoer of claim 1 wherein said carrier liquid is an isoparaffinic hydrocarbon solvent.

13. A liquid developer for use in electrophotographic processes consisting essentially of:

1. a carrier liquid having a specific resistance of more than about $10^{11}\Omega$cm selected from the group consisting of cyclohexane, decalin, kerosene, isoparaffinic hydrocarbon solvents, light oil, gasoline, chlorofluorinated hydrocarbon solvents and silicon oil.
2. positively charged toner pigment particles insoluble in said carrier liquid at a level of from about 0.5 to about 50 parts by weight per 1000 parts by weight of said carrier liquid, 3. a resin soluble in said carrier liquid, said resin being present in said carrier liquid in an amount of from about 0.5 to about 100 parts by weight per 1000 parts by weight of said carrier liquid, and
4. a copolymer of half-alkylamide of maleic acid and diisobutylene at a level of from about 0.0003 to about 0.5 parts by weight per 1000 parts by weight of said carrier liquid, the molar ratio of said half alkylamide of maleic acid to said diisobutylene in said copolymer being in the range of from about 1:1 to about 1:5 and said copolymer having from about 4 to about 50 monomer units in the copolymer chain.

14. The liquid developer as claimed in claim 13 wherein said liquid developer additionally contains up to about 20 parts by weight of an organic acid per 1000 parts by weight of said carrier liquid.

15. The liquid developer of claim 13 wherein said carrier liquid is an isoparaffinic hydrocarbon.

16. A liquid developer for use in electrophotographic processes consisting essentially of:

1. a carrier liquid having a specific resistance of more than about $10^{11}\Omega$cm selected from the group consisting of cyclohexane, decalin, kerosene, isoparaffinic hydrocarbon solvents, light oil, gasoline, chlorofluorinated hydrocarbon solvents and silicon oil,
2. from about 0.5 to about 50 parts by weight per 1000 parts by weight of said carrier liquid of positively charged toner particles having an average particle size of less than about 5 microns, said toner particles comprising particles of a reaction product produced by the graft polymerization to carbon black of an alkyl ester of acrylic or methacrylic acid, and
3. from about 0.0003 to about 0.5 parts by weight per 1000 parts by weight of said carrier liquid of a copolymer of a half alkylamide of maleic acid and diisobutylene, the molar ratio of said half alkylamide of maleic acid to said diisobutylene in said copolymer being in the range of from about 1:1 to about 1:5 and said copolymer having from about 4 to about 50 monomer units in the copolymer chain.

17. The liquid developer of claim 16 wherein said carrier liquid is an isoparaffinic hydrocarbon.

* * * * *